US007728243B2

(12) United States Patent
Lin et al.

(10) Patent No.: US 7,728,243 B2
(45) Date of Patent: Jun. 1, 2010

(54) KEYBOARD WITH WOBBLE PREVENTION STRUCTURE

(75) Inventors: Chin-Hung Lin, Taipei County (TW); Hsien-Tsan Chang, Pingtung County (TW); Chao-Lung Chang, Miaoli County (TW); Liang-Ta Yeh, Taipei County (TW)

(73) Assignee: Darfon Electronics Corp., Taoyuan (TW)

( * ) Notice: Subject to any disclaimer, the term of this patent is extended or adjusted under 35 U.S.C. 154(b) by 439 days.

(21) Appl. No.: 11/802,378

(22) Filed: May 22, 2007

(65) Prior Publication Data

US 2007/0272533 A1 Nov. 29, 2007

(30) Foreign Application Priority Data

May 23, 2006 (TW) ..... 95118244 A

(51) Int. Cl.
*H01H 13/70* (2006.01)

(52) U.S. Cl. ..... 200/344

(58) Field of Classification Search ..... 200/344, 200/314, 317, 343, 5 A, 517, 276, 276.1, 200/16 A, 600

See application file for complete search history.

(56) References Cited

U.S. PATENT DOCUMENTS 4,418,252 A * 11/1983 Daigle ..... 200/16 A
5,422,447 A * 6/1995 Spence ..... 200/5 A
6,860,612 B2 * 3/2005 Chiang et al. ..... 362/29
7,084,787 B2 * 8/2006 Olodort et al. ..... 341/22

* cited by examiner

*Primary Examiner*—Edwin A. Leon
(74) *Attorney, Agent, or Firm*—Birch, Stewart, Kolasch & Birch, LLP

(57) ABSTRACT

A keyboard with a wobble prevention structure, which is substantially a substrate having at least one press key arranged thereon while enabling each press key to be driven to move in a reciprocating manner following a specific direction, and having a plurality of position limit devices disposed on the substrate and beneath the periphery of a corresponding press key. In a preferred aspect, each position device is integrally formed with the substrate, or can be formed on the substrate by stamp forming technique, that each is used to confine the corresponding press key to move following only the specific direction, such that the wobbling of the press keys is prevented.

17 Claims, 3 Drawing Sheets

KEYBOARD WITH WOBBLE PREVENTION STRUCTURE

FIELD OF THE INVENTION

The present invention relates to a keyboard with a wobble prevention structure, and more particularly, to a simple-structured, ease-formed, low-cost keyboard structure with wobble prevention ability, capable of being manufactured by a simple manufacturing process that is suitable to be applied as the keyboard of devices, such as computers, cell phones or a personal digital assistants (PDAs), and especially adapted for keys with elastic scissors-like mechanism.

BACKGROUND OF THE INVENTION

A device such as a computer, a cell phone or a personal digital assistant (PDA) usually comes with a keyboard, and a press key structure of a computer keyboard as shown in FIG. 1 is a press key 10 with an elastic scissors-like mechanism. Compared with a traditional press key, the scissors-like press key 10 is advantageous in its long traveling path, evenly distributed acting force, and low noise, so that such press key is used extensively in thin-type keyboards, particularly the keyboards of notebook computers in recent years. The press key 10, disposed on a substrate 20 is composed of: a U-shaped first support arm 11, being pivotally coupled to a pivotal connecting shaft 13, and a second support arm 12 mounted on the first support arm 11. In addition, two position arm 111 are respectively arranged at the two sides of the first support arm 11 in a manner that each of which pieces through a position plate 21 mounted on the substrate 20 at positions corresponding to the two position arm 111. Since a vast majority of substrates 20 are made of metal, the position plate 21 can be formed by stamp forming, as those shown in FIGS. 2A and 2B. Each position plate 21 has a hole 211 for the position arm 111 to pass therethrough, so that the press key 10 can be pressed to move reciprocally along a direction F that is perpendicular to the extending of the substrate 20. When the press key 10 is not subjected to a pressing force, the first support arm 11 and the second support arm 12 can be forced to tilt upward from the substrate 20 by an elastic member (not shown in the figure) in a form of a scissor-like structure, as indicated by the dotted line in FIG. 2B. If the press key 10 is pressed, the first support arm 11 and the second support arm 12 are pressed flatly onto the substrate 20. To assure a smooth movement of the press key 10, the hole 211 and the position arm 111 are engaged loosely with a predetermined gap D. In addition, factors such as the tolerance of the size of the position plate 21, the distance between two position plates 21, and the size of the first support arm 11, and the existence of the aforementioned gap D may cause the press key 10 to shift and wobble, and thus affecting the overall stability of the press key when it is pressed, or even causing a malfunction of the press key when the pressing position is not aligned precisely.

SUMMARY OF THE INVENTION

Therefore, it is a primary objective of the invention to overcome the shortcomings of the prior art by providing a keyboard with wobble prevention structure having the features of a simple structure, an easy formation, a simple manufacturing procedure and a low cost, and such structure can definitely prevent a wobbling of the press keys.

To achieve the foregoing objective, the present invention provides a keyboard with wobble prevention structure, comprising:

a substrate;

at least a press key, mounted on the substrate in a manner that it can move reciprocally along a specific direction; and a plurality of position limit devices, disposed on the substrate and beneath the periphery of the at least one press-key to be used for limiting the press key from moving along a direction other than the aforesaid reciprocal-moving direction.

Preferably, the position limit devices are integrally formed with the substrate.

Preferably, the position limit devices are manufactured by performing a stamp forming process upon the substrate.

Preferably, the substrate is made of a metal.

Preferably, the position limit devices are disposed at positions corresponding to a left side and a right side of the press key.

Preferably, the position limit devices and the press key are engaged with each other loosely.

Preferably, the reciprocal moving direction of the press key is perpendicular to the extending of the substrate.

Preferably, the press key is a press key with an elastic scissors-like mechanism.

To achieve the foregoing objective, the present invention provides a keyboard with wobble prevention structure, wherein the keyboard structure can be a keyboard structure for a computer, a cell phone or a personal digital assistant (PDA).

DESCRIPTION OF THE PREFERRED EMBODIMENT

To make it easier for our examiner to understand the objective of the invention, its structure, innovative features, and performance, we use preferred embodiments together with the attached drawings for the detailed description of the invention.

Figure 1:
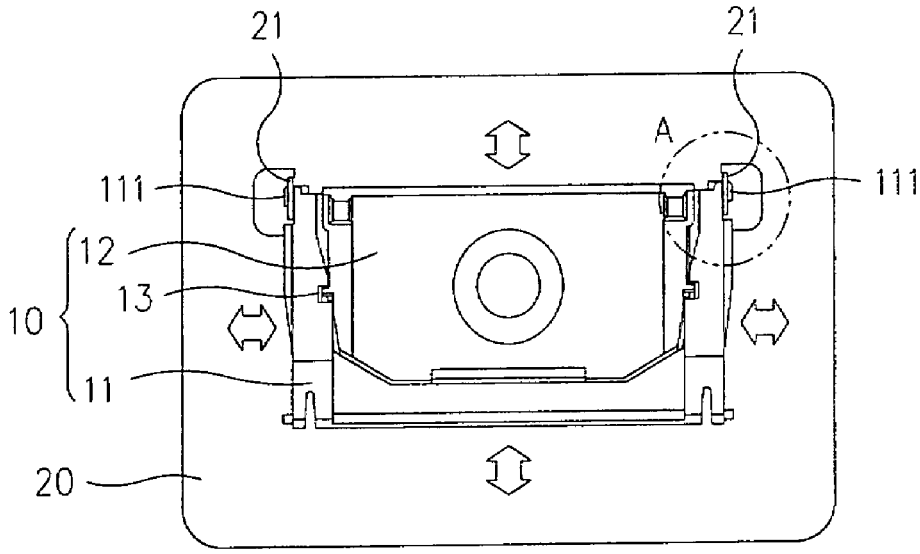
FIG. 1 (Prior Art)
FIG. 1 is a schematic view of a conventional press key structure.
Figure 2A:
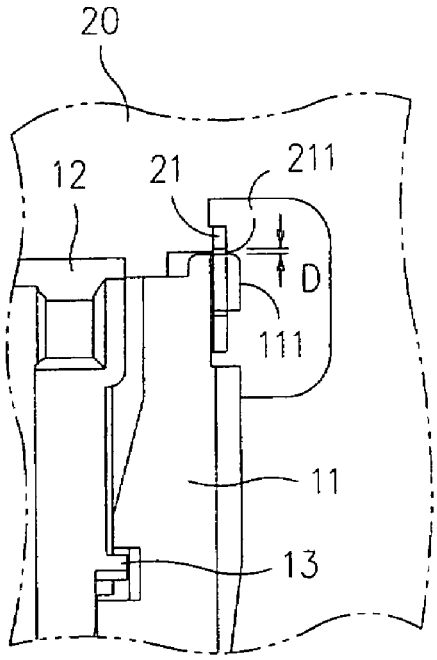
FIG. 2A (Prior Art)
FIG. 2A is an enlarged view of section A of FIG. 1.
Figure 2B:
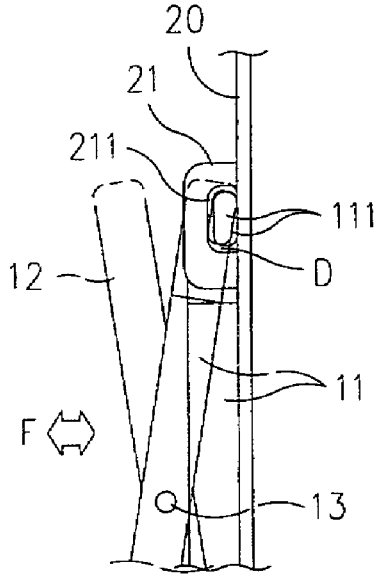
FIG. 2B (Prior Art)
FIG. 2B is a side view of FIG. 2A.
Figure 3:
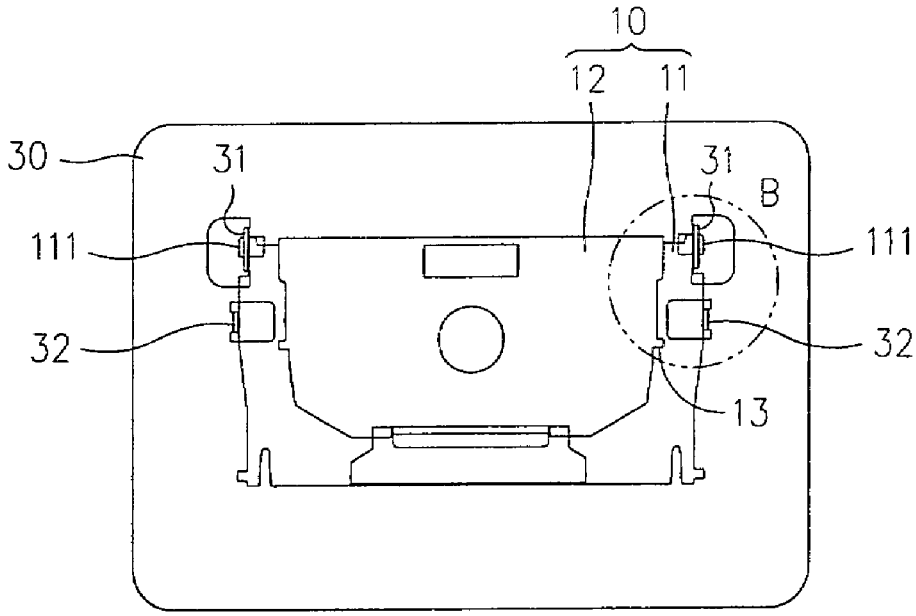
FIG. 3 is a schematic view of a structure in accordance with a preferred embodiment of the present invention.
Figure 4A:
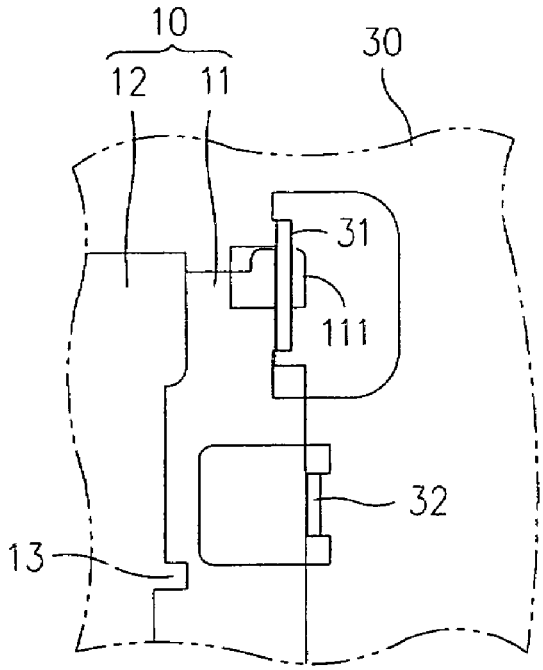
FIG. 4A is an enlarged view of section B of FIG. 3.
Figure 4B:
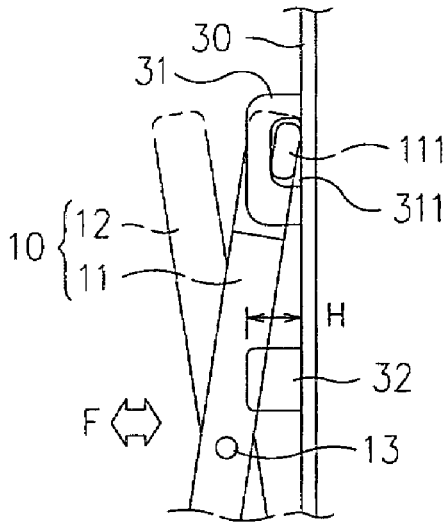
FIG. 4B is a side view of FIG. 4A.

Referring to FIGS. 3, 4A and 4B, a press key 10 with an elastic scissors-like mechanism is disposed on a substrate 30. Similarly, the press key 10 is pivotally coupled to a U-shaped first support arm 11 of a pivotal connecting shaft 13 and a second support arm 12 is installed in the first support arm 11 to constitute a keyboard structure. Both sides of the first support arm 11 have a position arm 111 each, for passing a position plate 31 installed at a position corresponding to the substrate 30. Since a vast majority of substrates 30 are made of metal, therefore the position plate 31 can be formed by stamping the substrate 30 as shown in FIG. 4B. The position plate 31 has a hole 311 for passing the position arm 111 therein, and the press key 10 is moved reciprocally along a direction F perpendicular to the substrate 30. In the keyboard with a wobble prevention structure in accordance with the present invention, both left and right sides of the first support arm 11 of the press key 10 have a plurality of position limit devices 32 symmetrically protruded from the substrate 30 and having an extended height H perpendicular to the substrate 30. The quantity, position and extended height H of the installed position limit devices 32 depend on the size of the press key 10 and the elevation path of the first support arm 11 or the second support arm 12. As shown in the figures, the position limit devices 32 are installed on both lateral sides of the first support arm 11. Such arrangement is sufficient to stop the first support arm 11 at the lateral side when the first support arm 11 elevates to its maximum position. Further, the material and formation of the position limit devices 32 depend on the material of the substrate 30. Since a vast majority of substrates 30 are made of metal, therefore the position limit device 32 and the substrate 30 can be formed integrally by a stamp forming process, and its loose engagement with the press key 10 can be controlled.

Figure 5:
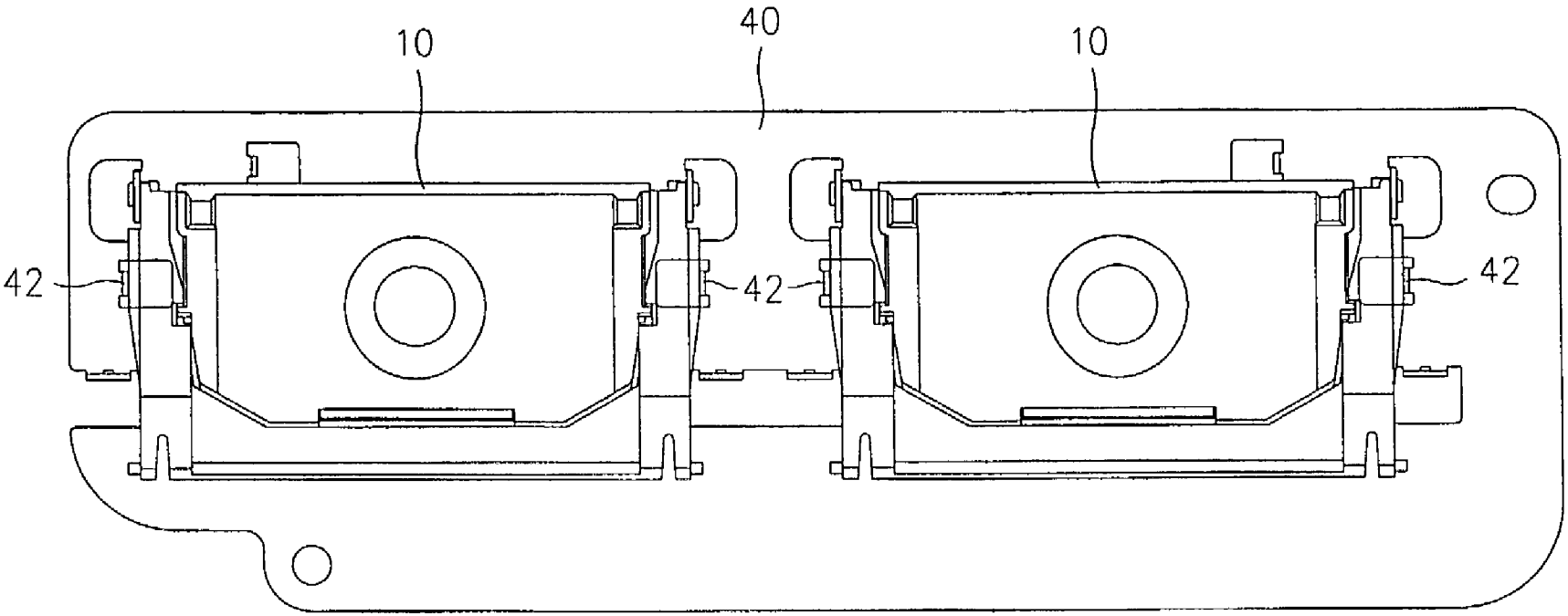
FIG. 5 is a schematic view of a structure in accordance with another preferred embodiment of the present invention.

Referring to FIG. 5 for a structure applied to a notebook computer keyboard, the substrate 40 installs two parallel rows of press keys 10, and a plurality of position limit devices 42 disposed on both left and right sides of the press key 10 and integrally formed with while protruding from the substrate 40. Regardless of the quantity of installed press keys or the size of substrate, the present invention can provide a position limit device for preventing a wobbling of the press keys, which can be applied in a keyboard structure of a computer, a cell phone or a personal digital assistant (PDA).

What is claimed is:

1. A press-key wobble prevention structure, comprising:

a substrate;

at least one press key, mounted on the substrate in a manner that it can move reciprocally along a specific direction;

at least one first support arm sandwiched between the at least one press key and the substrate; and a plurality of position limit devices, disposed on the substrate and beneath the periphery of the at least one press-key to be used for limiting the press key from moving along a direction other than the aforesaid reciprocal-moving direction, wherein each of the plurality of position limit devices extends from the substrate perpendicular thereto by a predeterminate height so that each of the plurality of position limit devices blocks against a side of the corresponding first support arm to avoid wobbling while the corresponding first support arm is being raised to its maximum height level.

2. The press-key wobble prevention structure as recited in claim 1, wherein the position limit devices are integrally formed with the substrate.

3. The press-key wobble prevention structure as recited in claim 1, wherein the position limit devices and the press key are engaged with each other loosely.

4. The press-key wobble prevention structure as recited in claim 1, wherein the substrate is made of a metal.

5. The press-key wobble prevention structure as recited in claim 1, wherein the position limit devices are disposed on positions corresponding to a left side and a right side of the press key.

6. The press-key wobble prevention structure as recited in claim 1, wherein the position limit devices loosely limit the press key.

7. The press-key wobble prevention structure as recited in claim 1, wherein the reciprocal moving direction of the press key is perpendicular to the extending of the substrate.

8. The press-key wobble prevention structure as recited in claim 1, wherein the press key is a press key with an elastic scissors-like mechanism.

9. A keyboard with wobble prevention structure, comprising:

a substrate;

at least one press key, mounted on the substrate in a manner that it can move reciprocally along a specific direction;

at least one first support arm sandwiched between the at least one press key and the substrate; and a plurality of position limit devices, disposed on the substrate and beneath the periphery of the at least one press-key to be used for limiting the press key from moving along a direction other than the aforesaid reciprocal-moving direction, wherein each of the plurality of position limit devices extends from the substrate perpendicular thereto by a predeterminate height so that each of the plurality of position limit devices blocks against a side of the corresponding first support arm to avoid wobbling while the corresponding first support arm is being raised to its maximum height level.

10. The keyboard with wobble prevention structure as recited in claim 9, wherein the position limit devices are integrally formed with the substrate.

11. The keyboard with wobble prevention structure as recited in claim 9, wherein the position limit devices are manufactured by performing a stamp forming process upon the substrate.

12. The keyboard with wobble prevention structure as recited in claim 9, wherein the substrate is made of a metal.

13. The keyboard with wobble prevention structure as recited in claim 9, wherein the position limit devices are disposed on positions corresponding to a left side and a right side of the press key.

14. The keyboard with wobble prevention structure as recited in claim 9, wherein the position limit devices and the press key are engaged with each other loosely.

15. The keyboard with wobble prevention structure as recited in claim 9, wherein the reciprocal moving direction of the press key is perpendicular to the extending of the substrate.

16. The keyboard with wobble prevention structure as recited in claim 9, wherein the press key is a press key with an elastic scissors-like mechanism.

17. The keyboard with wobble prevention structure as recited in claim 9, wherein the keyboard structure is a keyboard structure adapted for a device selected from the group consisting of a computer, a cell phone and a personal digital assistant (PDA).

* * * * *